US011745937B2

(12) United States Patent
Lee et al.

(10) Patent No.: US 11,745,937 B2
(45) Date of Patent: Sep. 5, 2023

(54) WEB OF CLEANING PRODUCTS HAVING A MODIFIED INTERNAL ATMOSPHERE AND METHOD OF MANUFACTURE

(71) Applicant: MONOSOL, LLC, Merrillville, IN (US)

(72) Inventors: David M. Lee, Clemmons, NC (US); David Brian Edwards, Old Town Stevenage (GB)

(73) Assignee: MONOSOL, LLC, Merrillville, IN (US)

( * ) Notice: Subject to any disclaimer, the term of this patent is extended or adjusted under 35 U.S.C. 154(b) by 563 days.

(21) Appl. No.: 16/713,710

(22) Filed: Dec. 13, 2019

(65) Prior Publication Data

US 2020/0115148 A1 Apr. 16, 2020

Related U.S. Application Data

(60) Division of application No. 15/543,246, filed as application No. PCT/US2016/013130 on Jan. 13, (Continued)

(51) Int. Cl.
*B65D 85/808* (2006.01)
*B65D 65/46* (2006.01)

(Continued)

(52) U.S. Cl.
CPC ..... *B65D 85/808* (2013.01); *B65B 9/042* (2013.01); *B65B 31/02* (2013.01); *B65D 65/46* (2013.01);

(Continued)

(58) Field of Classification Search
CPC .... B65D 85/808; B65D 65/46; B65D 75/327; B65D 75/40; B65D 75/44; B65D 75/48;

(Continued)

(56) References Cited

U.S. PATENT DOCUMENTS 3,508,373 A 4/1970 Robinson
4,058,953 A * 11/1977 Sanborn, Jr. ..... B65B 31/021 53/511

(Continued)

FOREIGN PATENT DOCUMENTS

GB 2361685 A 10/2001
JP 2003-531782 A 10/2003

(Continued)

OTHER PUBLICATIONS

Chinese Patent Application No. 201680008205.1, Notification of the First Office Action, dated Sep. 21, 2018.

(Continued)

*Primary Examiner* — Joshua G Kotis
*Assistant Examiner* — Scott A Howell
(74) *Attorney, Agent, or Firm* — MARSHALL, GERSTEIN & BORUN LLP

(57) ABSTRACT

A web of cleaning products and a method of manufacturing the same is disclosed. The web includes first and second carrier sheets and a plurality of pouches containing a cleaning composition. Each of the pouches is disposed in a respective depression formed in an upper surface of the first carrier sheet. A first internal atmosphere is enclosed within each of the pouches. The first carrier sheet is sealed to the second carrier sheet such that a second internal atmosphere exists between the second carrier sheet and the plurality of pouches. The second internal atmosphere has a greater absolute pressure than the first internal atmosphere so that the plurality of pouches and at least a portion of the cleaning composition in the plurality of pouches are compressed into the plurality of depressions in the first carrier sheet by the second internal atmosphere.

13 Claims, 6 Drawing Sheets

Related U.S. Application Data

2016, now Pat. No. 10,562,701, which is a continuation of application No. 14/596,984, filed on Jan. 14, 2015, now abandoned.

(51) Int. Cl.

| | |
|---|---|
| ***B65D 75/32*** | (2006.01) |
| ***B65D 75/40*** | (2006.01) |
| ***B65D 75/44*** | (2006.01) |
| ***B65D 77/06*** | (2006.01) |
| ***B65D 81/20*** | (2006.01) |
| ***B65D 81/32*** | (2006.01) |
| ***B65B 9/04*** | (2006.01) |
| ***C11D 17/04*** | (2006.01) |
| ***B65B 31/02*** | (2006.01) |
| ***B65D 75/48*** | (2006.01) |
| ***B65D 75/52*** | (2006.01) |
| ***B65B 61/00*** | (2006.01) |

(52) U.S. Cl.

CPC ..... *B65D 75/327* (2013.01); *B65D 75/40* (2013.01); *B65D 75/44* (2013.01); *B65D 75/48* (2013.01); *B65D 75/527* (2013.01); *B65D 77/06* (2013.01); *B65D 81/2023* (2013.01); *B65D 81/2084* (2013.01); *B65D 81/3261* (2013.01); *C11D 17/042* (2013.01); *B65B 61/005* (2013.01)

(58) Field of Classification Search

CPC .. B65D 75/527; B65D 77/06; B65D 81/2023; B65D 81/2084; B65D 81/3261; B65B 9/042; B65B 31/02; B65B 61/005; C11D 17/042

See application file for complete search history.

(56) References Cited

U.S. PATENT DOCUMENTS

| | | | | | |
|---|---|---|---|---|---|
| 4,340,138 | A * | 7/1982 | Bernhardt | B65D 51/18 | 206/541 |
| 5,025,611 | A * | 6/1991 | Garwood | B65B 31/00 | 53/511 |
| 5,129,512 | A * | 7/1992 | Garwood | B65D 81/24 | 53/433 |
| 5,226,531 | A * | 7/1993 | Garwood | B65B 31/021 | 53/433 |
| 5,744,182 | A * | 4/1998 | Andersson | B65B 25/001 | 426/316 |
| 6,213,294 | B1 * | 4/2001 | Colombo | A23L 3/3418 | 206/213.1 |
| 6,877,601 | B1 * | 4/2005 | Colombo | B65D 81/2076 | 53/434 |
| 7,464,519 | B2 | 12/2008 | Fisher et al. | | |
| 7,797,912 | B2 * | 9/2010 | Hammond | B65B 9/042 | 53/559 |
| 7,828,149 | B2 * | 11/2010 | Kalvelage | B65D 75/367 | 206/532 |
| 9,828,154 | B2 * | 11/2017 | Edwards | B65B 7/02 | |
| 2003/0152679 | A1 * | 8/2003 | Garwood | B65D 81/264 | 426/392 |
| 2004/0142131 | A1 * | 7/2004 | Edwards | B32B 27/20 | 428/35.7 |
| 2005/0153861 | A1 | 7/2005 | Wiedemann et al. | | |
| 2006/0281839 | A1 * | 12/2006 | Barthel | B65B 31/028 | 524/100 |
| 2007/0244024 | A1 | 10/2007 | Barthel et al. | | |
| 2008/0261851 | A1 | 10/2008 | Barthel et al. | | |
| 2008/0289989 | A1 * | 11/2008 | Kalvelage | B65D 75/367 | 206/531 |
| 2009/0134054 | A1 | 5/2009 | Lee et al. | | |
| 2010/0029535 | A1 | 2/2010 | Fregonese et al. | | |
| 2012/0128275 | A1 | 5/2012 | Voute | | |
| 2016/0200501 | A1 | 7/2016 | Lee et al. | | |

FOREIGN PATENT DOCUMENTS

| | | | |
|---|---|---|---|
| JP | 2008-510023 | A | 4/2008 |
| WO | WO-87/02965 | A1 | 5/1987 |
| WO | WO-2000/055045 | A1 | 9/2000 |
| WO | WO-2009/061933 | A1 | 5/2009 |

OTHER PUBLICATIONS

European Patent Application No. 16702015.5, Communication Pursuant to Article 94(3) EPC, dated Apr. 30, 2018.

European Patent Application No. 16702015.5, Communication Pursuant to Article 94(3) EPC, dated Mar. 4, 2019.

European Patent Application No. 16702015.5, Communication Pursuant to Article 94(3) EPC, dated Oct. 2, 2018.

International Search Report and Written Opinion, corresponding to International Application No. PCT/US2016/013130, dated Mar. 22, 2016.

U.S. Appl. No. 14/596,984, Nonfinal Office Action, dated Aug. 11, 2016.

U.S. Appl. No. 14/596,984, Final Office Action, dated Jan. 18, 2017.

U.S. Appl. No. 15/534,246, Final Office Action, dated May 7, 2019.

Japanese Patent Application No. 2017-537365, Office Action, dated Sep. 7, 2020.

Japanese Patent Application No. 2017-537365, Office Action, dated Jan. 14, 2020.

* cited by examiner

WEB OF CLEANING PRODUCTS HAVING A MODIFIED INTERNAL ATMOSPHERE AND METHOD OF MANUFACTURE

CROSS-REFERENCE TO RELATED APPLICATIONS

This is a divisional of U.S. patent application Ser. No. 15/543,246, filed Jul. 13, 2017, which is the US National Phase of International Patent Application No. PCT/US2016/013130, having an international file date of Jan. 13, 2016, and which claims the priority benefit of U.S. patent application Ser. No. 14/596,984, filed Jan. 14, 2015. The entire contents of each of the foregoing is expressly incorporated herein by reference.

TECHNICAL FIELD

The present disclosure generally relates to packaging and, more particularly, to packaging for unit and multi-dose cleaning products.

BACKGROUND

Unit dose cleaning products are preferred by many consumers for their ease of use and ability to prevent skin contact with irritating cleaning compositions. A unit dose cleaning product typically comprises a water-soluble pouch filled with a cleaning composition such as a granular detergent. The water-soluble pouch dissolves as a result of contact with water used in a cleaning cycle (e.g., an automatic dishwasher cleaning cycle) and consequently releases its dose(s) of the cleaning composition. The amount of cleaning composition within the water-soluble pouch is pre-measured and typically corresponds to the amount needed for a single cleaning cycle. Accordingly, the consumer is not required measure an appropriate amount of the cleaning composition prior to the cleaning cycle.

The exterior walls of the water-soluble pouch are typically very thin and thus susceptible to damage. To protect the water-soluble pouch prior to use, the water-soluble pouch is typically packaged within a protective container. One common type of protective container is a laminated barrier bag. Typically, multiple water-soluble pouches are packed, without separation, inside the laminated barrier bag. Therefore, if one of the water-soluble pouches breaks, the cleaning composition it leaks may compromise the integrity of the other water-soluble pouches inside the laminated barrier bag. Also, laminated barrier bags tend to be bulky and difficult to stack, and consequently require a substantial amount of shelf space. Furthermore, laminated barrier bags typically are made of a material that falls under Classification #7 of the Standard Classification System for Specifying Plastic Materials, such as oriented polypropylene (OPP), biaxially oriented polypropylene (BOPP), and/or polyethylene (PE). In general, such materials are difficult to recycle and thus undesirable from an environmental perspective.

Another type of protective container comprises first and second carrier sheets made of a relatively rigid and water-resistant material. The first carrier sheet includes a plurality of depressions in which the water-soluble pouches are positioned, and the second carrier sheet is sealed to the upper surface of the first carrier sheet to enclose each water-soluble pouch inside its corresponding depression. This type of packaging prevents the leaked contents of a damaged water-soluble pouch from affecting the other water-soluble pouches inside the container. Also, it may be easier to stack this type of container on a shelf than a laminated barrier bag.

One method of manufacturing such a container is described in U.S. Patent Application Publication No. 2004/0142131. The method involves simultaneously thermoforming a first water-soluble film and a first carrier sheet to create a plurality of internal holders in the first water-soluble film and a plurality of depressions in the first carrier sheet. An effect of thermoforming the first water-soluble film and the first carrier sheet at the same time is that the first water-soluble film acquires a temporary, or permanent, affinity for the first carrier sheet. As a result, the internal holders formed in the first water-soluble film retain their shape and are less likely to experience shrink-back prior to filling with the cleaning composition. Accordingly, it is possible to utilize the full volume of the internal holders at the filing stage.

After the internal holders have been filled with the cleaning composition, a second water-soluble film is sealed to the upper surface of the first water-soluble film, about the rims of the internal holders. This creates the plurality of water-soluble pouches. Typically, the first and second films are sealed together in an environment having an ambient pressure equal to, or substantially equal to, atmospheric pressure. As a result, the pressure inside the water-soluble pouches is equal to, or substantially equal to, atmospheric pressure, both during and after the sealing process. Accordingly, the water-soluble pouches do not experience a net external compressive force when placed in an environment having ambient pressure equal to atmospheric pressure.

Typically, the cleaning composition is loosely packed within the water-soluble pouches. The loose packing, combined with the relatively flexible exterior walls of the water-soluble pouches, renders the water-soluble pouches somewhat soft and, in some cases, unable to retain their shape when subjected to light abuse. Incomplete filling of the water-soluble pouches with the cleaning composition can also result in the water-soluble pouches being malleable. Although the water-soluble pouches may initially be attracted to the rigid carrier sheet as a result of being thermoformed simultaneously (as discussed in U.S. Patent Application Publication No. 2004/0142131), over time the affinity between the water-soluble pouches and the rigid carrier sheet may be lost. Consequently, by the time the consumer opens the container, the water-soluble pouches may no longer conform the shape of the depressions in the rigid carrier sheet. For example, the corners of the water-soluble pouch may become rounded even though the corners of the depression in the rigid carrier sheet are sharp and well-defined. The atmosphere surrounding the water-soluble pouches inside the container cannot be relied upon to compress and maintain the shape of the water-soluble pouches because, as noted above, a pressure differential typically does not exist between the interior of the water-soluble pouches and the surrounding atmosphere.

Consumers may perceive the soft and squishy feel of the water-soluble pouches as being indicative of low or inferior quality. Additionally, the inability of the water-soluble pouches to retain their shape limits their use in applications requiring specific geometric shapes.

SUMMARY

One aspect of the present disclosure provides a web of cleaning products including first and second carrier sheets and a plurality of pouches. The first carrier sheet has a plurality of depressions formed in its upper surface. Each of the plurality of pouches is disposed in a corresponding one of the plurality of depressions and contains a cleaning composition. The second carrier sheet is sealed to the upper surface of the first carrier sheet and encloses the plurality of pouches within their corresponding depressions. Each of the plurality of pouches encloses a first internal atmosphere. A second internal atmosphere exists between the first carrier sheet and the plurality of pouches. The second internal atmosphere has a greater absolute pressure than the first internal atmosphere so that the plurality of pouches and at least a portion of the cleaning composition in the plurality of pouches are compressed into the plurality of depressions in the first carrier sheet by the second internal atmosphere.

Another aspect of the present disclosure provides a cleaning product including first and second water-resistant carrier sheets and a water-soluble pouch containing a cleaning composition. The first water-resistant carrier sheet has a depression formed in its upper surface, and the water-soluble pouch is disposed in the depression. The second water-resistant carrier sheet sealed to the upper surface of the first water-resistant carrier sheet about a rim of the depression. A first internal atmosphere is enclosed within the water-soluble pouch. A second internal atmosphere exists between the first water-resistant carrier sheet and the water-soluble pouch. The second internal atmosphere has a greater absolute pressure than the first internal atmosphere so that the water-soluble pouch and at least a portion of the cleaning composition are compressed into the depression in the first water-resistant carrier sheet by the second internal atmosphere.

Yet another aspect of the present disclosure includes a method of making a web of cleaning products. The method includes: (a) positioning a first film to cover a first carrier sheet; (b) feeding the first film and the first carrier sheet on to a mold of a forming machine with the first carrier sheet being positioned between the mold and the first film; (c) forming the first film and the carrier sheet over the mold at the same time to define a plurality of internal holders in the first film and a plurality of external holders in the first carrier sheet corresponding with the plurality of internal holders; (d) filling each of the plurality of internal holders with a cleaning composition; (e) positioning a second film to cover the first film; (f) evacuating air between the first film and the second film; (g) sealing the second film about a rim of each of the plurality of holders to define a plurality of pouches; (h) exposing the plurality of pouches to an external pressure greater than an internal pressure of each of the plurality of pouches so that the external pressure compresses the plurality of pouches and at least a portion of the cleaning composition in the plurality of pouches into the plurality of external holders in the first carrier sheet; and (i) sealing a second carrier sheet to the first carrier sheet to enclose the plurality of pouches in their corresponding external holders.

DETAILED DESCRIPTION

The present disclosure generally concerns the manufacture and configuration of a web of cleaning products having a modified internal atmosphere. The web may be created by thermoforming a first water-soluble film to a first water-resistant carrier sheet, and subsequently, sealing a second water-soluble film to the first water-soluble film to define a plurality of water-soluble pouches. A second water-resistant carrier sheet may be sealed to the upper surface of the first water-resistant carrier sheet to cover and enclose the water-soluble pouches within respective depressions in the first water-resistant carrier sheet. Prior to, or subsequent to, the sealing of the first and second water-soluble films, the air between the first and second water-soluble films may be completely, or partially, evacuated so that the resulting water-soluble pouches have an internal atmosphere whose pressure is lower than the atmosphere outside the water-soluble pouches. The difference in pressure results in the compression of the water-soluble pouches and at least a portion of their cleaning composition. More particularly, the water-soluble pouches are compressed into their respective depressions in the first water-resistant carrier sheet and thereby conform to the interior shape of their respective depressions. The compression of the cleaning composition may solidify the cleaning composition and thereby impart the water-soluble pouches with a relatively solid structure of substantial integrity and form. Accordingly, the water-soluble pouches can be made with shape that is better defined, more durable, aesthetically pleasing, and/or customized for a particular application. Additionally, evacuation of the water-soluble pouches may increase the speed at which they dissolve when exposed to water.

Figure 1:
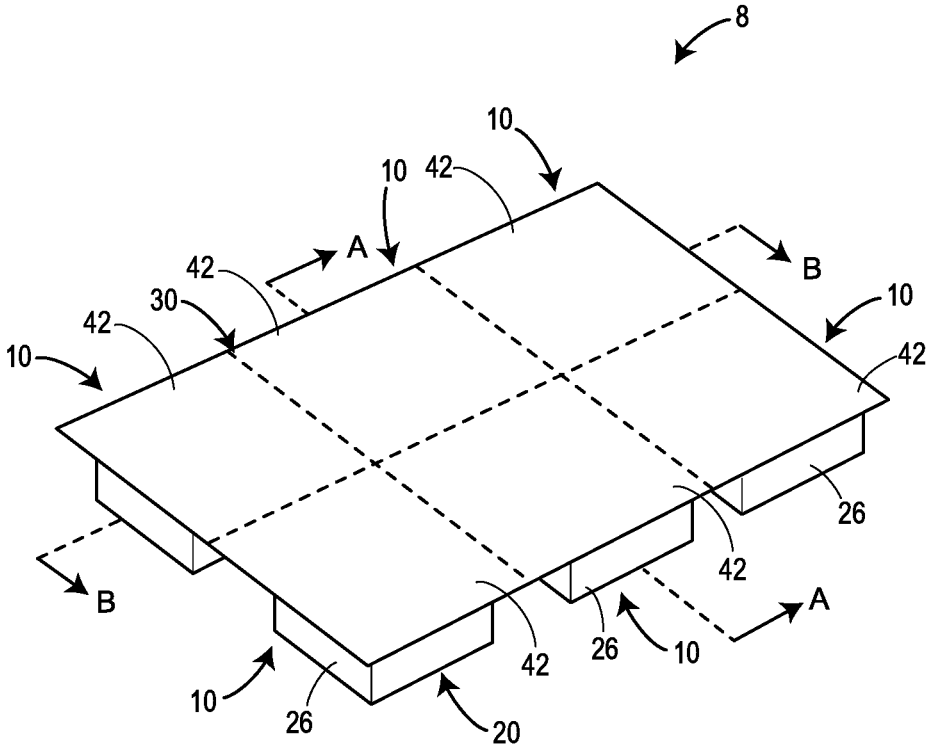
FIG. 1 is a perspective view of one embodiment of a web of cleaning products constructed in accordance with principles of the present disclosure.

FIG. 1 illustrates one possible embodiment of a web 8 of cleaning products 10. The web 8 includes a first carrier sheet 20 having a plurality of depressions 26. The depressions 26 each may be created by thermoforming the first carrier sheet 20 over a mold, as discussed below in more detail. The depressions 26 are configured to hold one or more pouches of cleaning composition and protect them from environmental elements. The depth of each of the depressions 26 may be equal to, or substantially equal to, the height of the pouch to be positioned within the depression 26.

Figure 2:
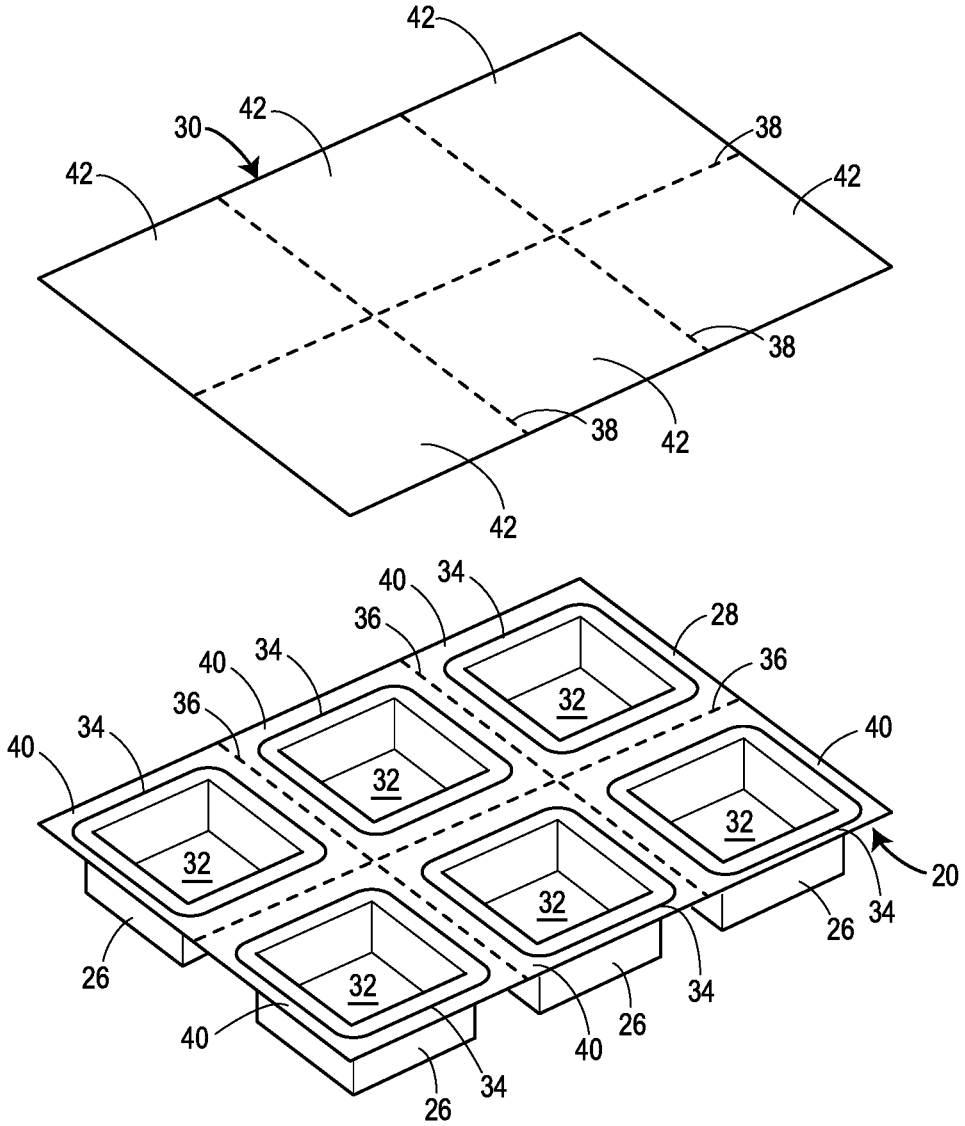
FIG. 2 is an assembly view of the first and second carrier sheets of the web of FIG. 1 without the pouches.

FIG. 2 illustrates that the first carrier sheet 20 may have a rectangular outer peripheral edge, and shows that the depressions 26 may be arrayed across and formed in the upper surface 28 of the carrier sheet 20 in a pattern of parallel and aligned rows and columns. The depressions 26 may each have a squarish cross-section that facilitates release of the depressions 26 from a mold during thermoforming. Other suitable cross-sectional shapes for the depressions 26 include a circle, semi-circle, rectangle, polygon, etc. In one embodiment, the first carrier sheet 20 possesses a circular outer peripheral edge, and the depressions 26 are arranged in a radial pattern resembling slices of a pie. Such a configuration of the first carrier sheet 20 may facilitate placement of the web 8 in the dish rack, or other dish holder, of an automatic dishwasher.

A second carrier sheet 30 is sealed to the upper surface 28 of the first carrier sheet 20. The second carrier sheet 30 covers each of the depressions 26 and thereby defines a plurality of interior cavities 32. As depicted in FIG. 2, lines of sealing material 34 may be applied to the upper surface 28 of the first carrier sheet 20 to provide adhesion for the second carrier sheet 30, and to inhibit, or prevent, environmental elements (e.g., water, water vapor, air, etc.) from entering the space between the first and second carrier sheets 20 and 30.

Each line of sealing material 34 may surround the rim of a corresponding one of the depressions 26, as shown in FIG. 2. This allows an internal atmosphere to be created in each of the interior cavities 32, as discussed below in more detail. Alternatively, a single line of sealing material 34 may be formed around the outer periphery of first carrier sheet 20. In such an embodiment, the interior cavities 32 may share the same internal atmosphere.

The lines of sealing material 34 may be made of a low tack peelable adhesive (e.g., a UV-curable acrylic oligomer). In one embodiment, the lines of sealing material 34 may be omitted, and instead, the first and second carrier sheets 20 and 30 are welded (e.g., heat welded, vibration welded, ultrasonic welded, solvent welded, or any combination thereof) along paths corresponding to the position of the lines of sealing material 34 illustrated in FIG. 2.

Referring to FIG. 2, weakened tear lines 36, 38 may be formed in the first and second carrier sheets 20 and 30, respectively. Each of the weakened tear lines 38 may be aligned with a corresponding one of the weakened tear lines 36 when the second carrier sheet 30 is positioned to overlap the first carrier sheet 20. The weakened tear lines 36, 38 may be formed by any suitable method including, for example, laser etching and/or scoring. The weakened tear lines 36, 38 may facilitate individual detachment of the cleaning products 10 from the web 8.

As shown in FIG. 2, the weakened tear lines 36 may divide the first carrier sheet 20 into a plurality of external holders 40, each having its own depression 26 surrounded by a line of sealing material 34. Similarly, the weakened tear lines 38 may divide the second carrier sheet 30 into a plurality of external lids 42, each covering a corresponding one of the external holders 40. Since the weakened tear lines 36, 38 border the outside of each line of sealing material 34, tearing the web 8 along the weakened tearing lines 36, 38 to remove one of the cleaning products 10 from the web 8 may not compromise the seal of the remaining cleaning products 10.

The first and second carrier sheets 20 and 30 are preferably made of a water-resistant material (e.g., a water-insoluble, hydrophobic material such as plastic) and is preferably rigid. The rigidity of the first and second carrier sheets 20 and 30 may allow the web 8 to be stacked beneath multiple other webs 8 without experiencing substantial deformation. Also, the rigidity of the first and second carrier sheets 20 and 30 may enable the web 8 to be oriented in an upright configuration in a rack (e.g., a dish rack of an automatic dishwasher) without sagging under its own weight. Suitable materials for the first and second carrier sheets 20 and 30 include, but are not limited to, amorphous polymers (e.g., styrene and styrenic blends) and/or semi-crystalline polymers (e.g., thermoplastic polyesters and nylons). Preferably, the first and second carrier sheets 20 and 30 are made of a recyclable material (e.g., polyethylene terephthalate (APET), polypropylene, etc.) so that the environmental impact of disposing the first second carrier sheet 20 and 30 is reduced. The thickness of the first carrier sheet 20 and/or the second carrier sheet 30 may be within a range between approximately (e.g., ±10%) 60-1000 μm, or 170-750 μm, or lesser or greater. In one embodiment, the first and second carrier sheets 20 and 30 are each made of a water-resistant film which is 170 μm thick and which includes amorphous polyester, APET.

Figure 3:
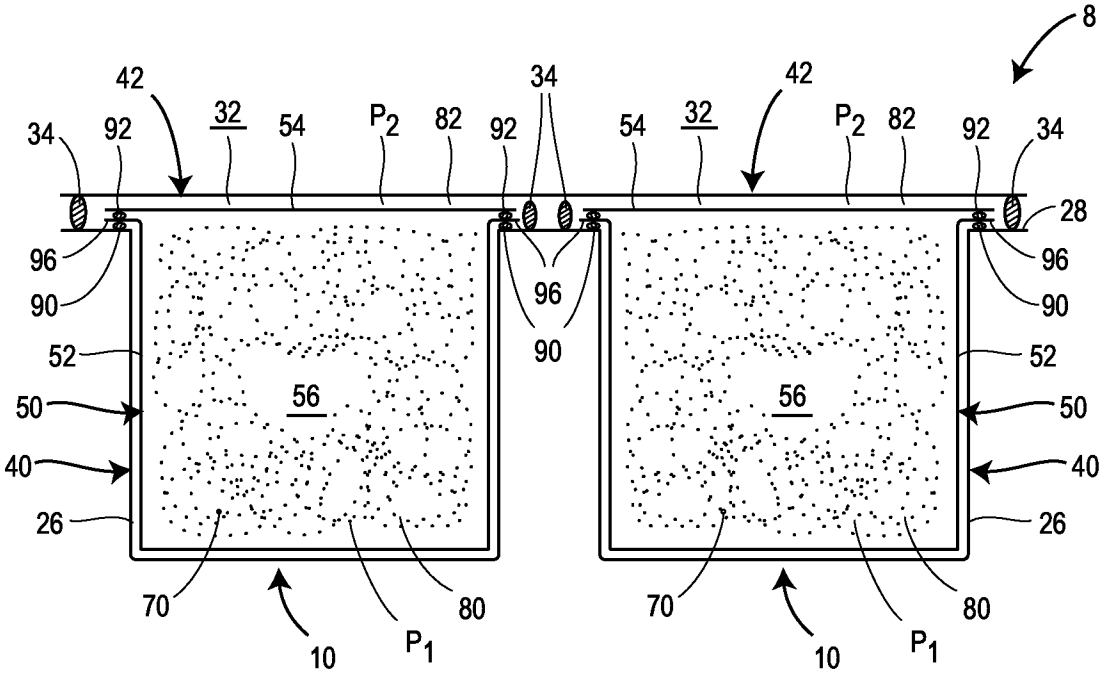
FIG. 3 is a cross-sectional view of FIG. 1 along plane A-A.
Figure 4:
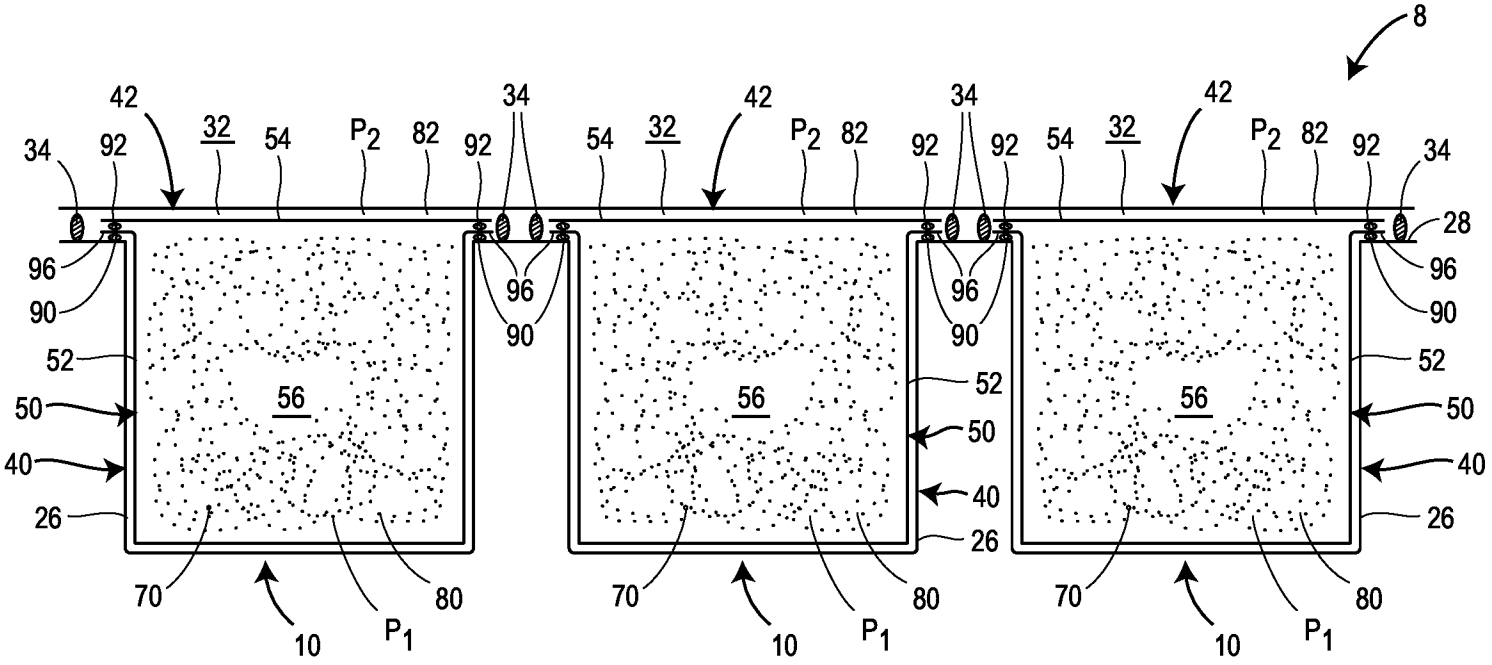
FIG. 4 is a cross-sectional view of FIG. 1 along plane B-B.

Referring to FIGS. 3 and 4, a plurality of pouches 50 are positioned in the depressions 26 in the first carrier sheet 20. Each depression 26 may contain a single pouch 50, or multiple pouches 50. Each pouch 50 may be formed by an internal holder 52 and an internal lid 54. The shape of each internal holder 52 may substantially correspond to the shape of the depression 26 intended to house the internal holder 52. The internal lid 54 may cover and seal shut an open end of the internal holder 52 so that an interior cavity 56 is defined between internal lid 54 and the internal holder 52. The interior cavity 56 of the pouch 50 is filled with at least one cleaning composition 70. Additionally, as discussed further below, the interior cavity 56 may possess an internal atmosphere whose pressure is lower than the atmosphere surrounding the exterior of the pouch 50. In one embodiment, the internal atmosphere of the pouch 50 may be a vacuum.

A first film 60 may be used to make the internal holders 52, and a second film 62 may be used to make the internal lids 54. The first and second films 60, 62 are preferably made of a water-soluble material (e.g., a hydrophilic material), and may be flexible or rigid. The water-soluble material may be cold-water soluble or hot-water soluble. A cold-water soluble material is one that is soluble in water at 20° C. or less, while a hot-water soluble material is one which is soluble in water at 60° or more. Material which is soluble between these temperatures can also be used. A pouch 50 made of a cold-water soluble material may release the cleaning composition 70 in three minutes or less when placed in un-agitated water at 20° C. or less. A pouch 50 made of a hot-water soluble material may release the cleaning composition 70 in three minutes or less when placed in un-agitated water at 60° or more.

The first film 60 and/or the second film 62 may be a mono-layer film or a multi-layer laminated film. Furthermore, the first film 60 and/or the second film 62 may be perfumed or colored to obtain aesthetically pleasing characteristics, or from any combination of these features. In some embodiments, the first film 60 and/or the second film 62 may be transparent or translucent. In some embodiments, the first and second films 60, 62 may be made of different grades, thicknesses, and/or materials.

Preferred materials for the first and second films 60, 62 include polyvinyl alcohol (PVOH), cellulose derivatives such as cellulose ethers (e.g., hydroxypropyl methyl cellulose (HPMC)), polyglycolides, polylactides, and/or polylactide-polyglycolide copolymers. The PVOH may be partially or fully hydrolyzed homopolymer of polyvinyl acetate (e.g., a copolymer of vinyl alcohol groups and vinyl acetate groups, or all vinyl alcohol groups). Additionally, the PVOH may be a partially or fully hydrolyzed modified PVOH (for example 1-10 mole % anionic copolymer comprising groups such as monomethyl maleate sodium salt or 2-Acrylamido-2-methylpropane sulfonate sodium salt. For example, the PVOH may be alcoholised or hydrolysed in a range between 40-100%, or between 70-92%, or between 88-92%. In one embodiment, where the PVOH is fully hydrolysed, the level of hydrolysis may be 99% or higher. The degree of hydrolysis is known to influence the temperature at which the PVOH starts to dissolve in water. 88% hydrolysis corresponds to a film soluble in cold (e.g., room temperature) water, whereas 92% hydrolysis corresponds to a film soluble in warm water. The material for the first and second films 60, 62 may also, in various embodiments, contain plasticizers and mold release agents, which may facilitate manufacturing of the pouches 50. The material for the first and second films 60, 62 may be produced by any process including, for example, extrusion, blowing, and/or casting. The material may be un-oriented, mono-axially oriented, or bi-axially oriented. If the layers are oriented, they usually have the same orientation, although their planes of orientation may differ.

The thickness of the first and/or second films 60, 62 may be in a range between approximately (e.g., ±10%) 20-500 μm, or 30-300 μm, or 35-200 μm, or between 40-160 μm, or 40-150 μm, or 40-120 μm. In one embodiment, the first and/or second films 60, 62 may be made of a PVOH film available as MonoSol M8630, and may have a thickness of approximately (e.g., ±10%) 75 μm.

Each of the pouches 50 may be divided into multiple chambers (not illustrated) by internal walls so that each pouch 50 can hold multiple cleaning compositions, and keep them separated. For example, one of more of the pouches 50 may have a first chamber filled with a powdered dishwashing detergent and a second chamber filled with a liquid rinse aid. The walls forming the different chambers may have different thicknesses so that the first and second chambers release their respective cleaning compositions at different times.

The cleaning composition 70 may be any composition which is intended to be released in an aqueous environment. The cleaning composition 70 may be a dishwashing detergent, laundry detergent, water softener, rinse aid, salt, enzyme, bleach, bleach activator, surface cleaner, etc. The cleaning composition 70 may have disinfectant, antibacterial, or antiseptic properties. The cleaning composition 70 may take any appropriate form including, but not limited to, a liquid, gel, paste, solid, granules, or powder. In one embodiment, the cleaning composition 70 may take the form of a mull, consisting of a mixture of particles which are insoluble in a carrier (e.g., a mixture containing water-soluble particles and a glycerol or propylene glycol carrier incapable of dissolving the water-soluble particles).

The cleaning composition 70 may be loosely packed in the pouches 50 as a result of the filling process. Empty space therefore may exist between particles of the cleaning composition 70 and/or between the cleaning composition 70 and the internal lid 54. To reduce or eliminate the empty space, each of the pouches 50 may be completely, or partially, evacuated so that each of the pouches 50 contains an internal atmosphere 80 with a pressure $P_1$ that is lower than a pressure $P_2$ of the atmosphere outside the pouch 50. The outside atmosphere may correspond to an internal atmosphere 82 at least between the second carrier sheet 30 and the pouches 50. In the illustrated embodiment, where the interior cavities 32 are sealed from each other, each of the interior cavities 32 may have its own internal atmosphere 82.

In one embodiment, the exterior walls of each pouch 50 may press flushly, and sealingly, against the interior walls of its respective depression 26 in the first carrier sheet 20, with no gaps therebetween, so that the internal atmosphere 82 is confined to a region above the pouch 50 and below the second carrier sheet 30, and so that the internal atmosphere 82 does not exists between each pouch 50 and its respective depression 26. In such an embodiment, the internal atmosphere 82 would only push in the downward direction on the pouch 50 and thus into the depression 26. Although FIGS. 3 and 4 illustrate a small gap between each of the pouches 50 and the interior walls of its respective depression 26, in reality each of the pouches 50 may be flush with the interior walls of its respective depression 26 such that there is no empty space between them. This arrangement may result from a natural affinity that develops between the first film 60 and the first carrier sheet 20 during the thermoforming process, which is discussed below in more detail. The absence of a gap between the pouch 50 and the interior walls of its respective depression 26 may be instrumental in confining the internal atmosphere 82 to a region of the cavity 32 above the pouch 50. As a result, the internal atmosphere 82 may exert a force on the upper surface of the pouch 50 that only has a downward component. In alternative embodiments, the atmosphere 82 may be allowed to surround the pouch 50 such that the pressure $P_2$ pushes inwardly from all sides of the pouch 50.

As illustrated in FIGS. 3 and 4, the internal holder 52 of each of the pouches 50 may be sealed to the upper surface of its respective external holder 40 (i.e., the upper surface 28 of the first carrier sheet 20) and about the rim of its respective depression 26. Each of the internal holders 52 may have a peripheral flange 96 that extends outwardly away from a remainder of the internal holder 52 in a horizontal direction and above the upper surface 28 of the first carrier sheet 20 to facilitate the formation of the seal. The seal may help confine the internal atmosphere 82 to the region of the cavity 32 above the pouch and thus provide additional protection against the internal atmosphere 82 working its way between the pouch 50 and the interior walls of its respective depression 26. To create the seal, a line of sealing material 90 may be applied to the upper surface 28 of the first carrier sheet 20 prior to covering the upper surface 28 with the first film 60. The line sealing material 90 may be separate from a line of sealing material 92 that seals the internal lid 54 to its respective internal holder 52. Each line of sealing material 90 may be made of a low tack peelable adhesive (e.g., a UV-curable acrylic oligomer) thereby allowing a consumer to remove the pouch 50 from its external holder 40 without damaging the pouch 50. In one embodiment, the lines of sealing material 90 may be omitted, and instead, each internal holder 52 and its respective external holder 40 may welded together (e.g., heat welded, vibration welded, ultrasonic welded, solvent welded, or any combination thereof) along paths corresponding to the position of the lines of sealing material 90. In such an embodiment, the lines of sealing material 92 may also be omitted, and the same welding operation used to weld the internal holder 52 and the external holder 50 may be used for welding the internal holder 52 and the internal lid 54.

The pressure differential $\Delta P$ between the pressure $P_1$ and the pressure $P_2$ results in a compressive force exerted against the exterior of each of the pouches 50. In an embodiment where the internal atmosphere 82 is confined to a region about the each of the pouches 50, the compressive force may push the pouches 50 down into their respective depressions 26 in the first carrier sheet 20 and hold the pouches 50 in this position. Accordingly, the exterior shape of each of the pouches 50 may conform, and stay conformed, to the interior shape of its respective depression 50 in the first carrier sheet 20. This may allow the pouches 50 to be imparted with a complex three-dimensional shape having many detailed and precise contours, corners, grooves, etc.

Since the pouches 50 may be made of a relatively flexible material, such as a PVOH film, the compressive force may shrink the pouches 50, thereby reducing their interior volumes. Consequently, empty space between the particles of the cleaning composition 70, and/or between the cleaning composition 70 and the internal lid 54, may be substantially reduced or eliminated. The reduction in empty space may increase the overall rigidity and/or hardness of the pouches 50. The pouches 50 therefore may be able to retain their three-dimensional geometric shape (e.g., a cube, rectangular prism, triangular prism shape, cone, sphere, hemisphere, etc.), regardless of the presence of the first and second carrier sheets 20 and 30. The better defined shape and increased hardness of the pouches 50 may render the pouches 50 suitable for applications requiring customized shapes (e.g., a dishwasher detergent tray having a unique shape), and may be more attractive to consumers, particularly those associating hardness with superior quality.

In one embodiment, the first and second films 60 and 62 used to make the pouches 50 may be substantially impervious to oxygen, nitrogen, water vapor, and/or other gases. As such, the permeation rate of the pouches 50 may be low enough to ensure that the pressure differential ΔP between the pressure $P_1$ and the pressure $P_2$ remains constant, or substantially constant, while the pouches 50 are stored between the first and second carrier sheets 20 and 30.

The evacuation of air from the pouches 50 reduces empty space in pouches 50 filled with a granular or powdered cleaning composition, as well as, pouches 50 filled with a liquid or gel cleaning composition. While evacuation may not, by itself, solidify a liquid or gel cleaning composition, evacuation eliminates air pockets and/or bubbles that may be present and the reduction in empty space inside the pouch 50 makes it less likely that the pouch 50 will fail to conform with the interior shape of its respective depression 26.

It should be understood that the pressures $P_1$, $P_2$, and any other pressure referred to herein, are absolute pressures. An absolute pressure is measured relative to the zero pressure of an absolute vacuum. All references to atmospheric pressure herein are equal to approximately (e.g., ±10) 101.3 kPa.

In one embodiment, the internal atmosphere 80 of each of the pouches 50 may correspond to a vacuum whose pressure $P_1$ is equal to, or substantially equal to, zero; and the pressure $P_2$ of the internal atmosphere 82 between the first and second carrier sheets 20 and 30 may be equal to, or substantially equal to, atmospheric pressure. In such an embodiment, the pressure differential ΔP would be approximately (e.g., ±10) 101.3 kPa. One benefit of creating an internal atmosphere 80 with a pressure $P_1$ below atmospheric pressure is that, when the consumer unseals the first and second carrier sheets 20 and 30 and removes the pouch 50, the ambient atmospheric pressure may provide an external compressive force that maintains the rigidity of the pouch 50.

In some embodiments, the internal atmosphere 80 of each of the pouches 50 may be comprised of a gaseous mixture different from air. This may be accomplished by flushing the interior cavities 56 of the pouches 50 with the gaseous mixture, as discussed below in more detail. In such an embodiment, the pressure $P_1$ of the internal atmosphere 80 may be between zero and atmospheric pressure. The gaseous mixture may help preserve the chemical characteristics of the cleaning composition 70 while it is stored inside the pouch 50 and/or facilitate a cleaning function upon the pouch 50's disintegration in a cleaning cycle (e.g., the gaseous mixture may provide a rinse aid). In one embodiment, the gaseous mixture may provide a perfumed scent that is aesthetically pleasing to consumers.

In the present embodiment, each of the cleaning products 10 is defined by the combination of one of the pouches 50, one of the external holders 40, and one of the external lids 42. In another embodiment, each of the external holders 40 may possess two or more depressions 26, each containing its own respective pouch 50. In such an embodiment, each cleaning product 10 would define a multi-dose cleaning product. Furthermore, each cleaning product 10 may include two or more pouches containing different cleaning compositions, each serving a different function in a single cleaning cycle. For example, one of the pouches 50 may contain a dishwashing detergent, and another one of the pouches 50 may contain a water-softener, salt, enzyme, rinse aid, bleach, or bleach activator. The pouch 50 containing the water-softener, salt, enzyme, rinse aid, bleach, or bleach activator may dissolve at a faster rate than the pouch containing the dishwashing detergent. Accordingly, the water-softener, salt, enzyme, rinse aid, bleach, or bleach activator may be released near the start of an automatic dishwasher cleaning cycle, whereas the dishwashing detergent may be released near the end of the automatic dishwasher cleaning cycle.

While the embodiment of the web 8 illustrated in FIGS. 1-4 includes six cleaning products 10, other embodiments of the web can be configured differently, for example, with one, two, three, four five, seven, eight, nine, ten or more cleaning products.

Figure 5:
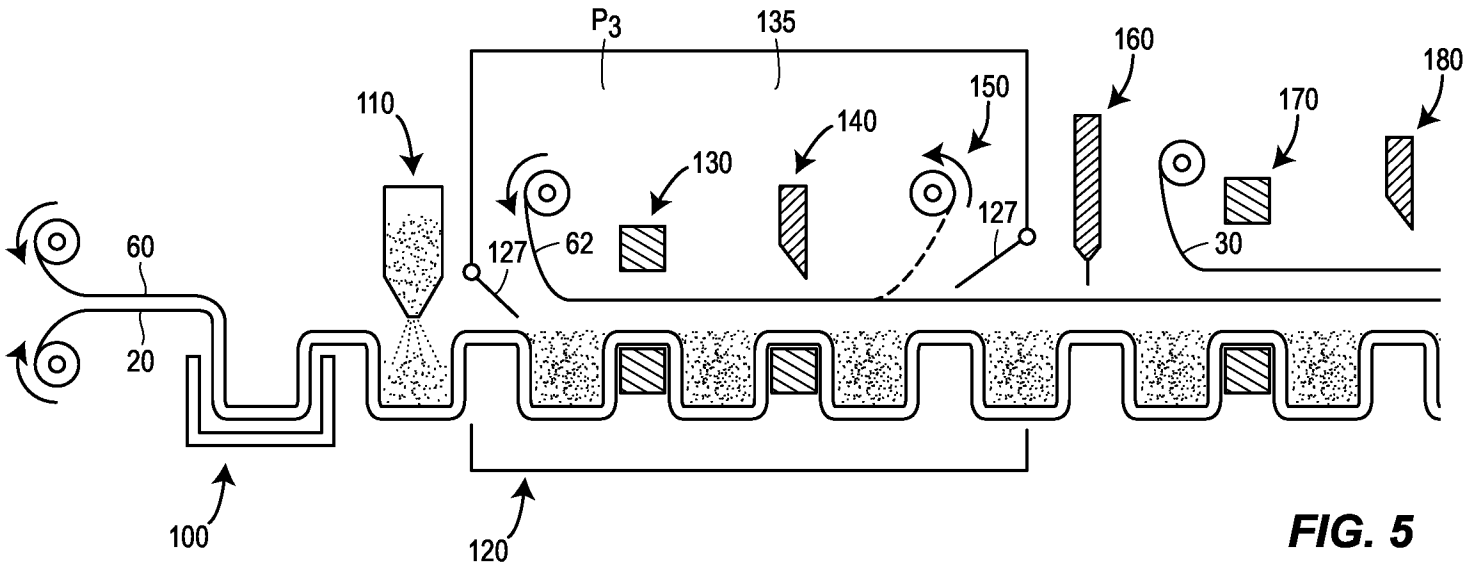
FIG. 5 is a schematic representation of one embodiment of a method of making a web of cleaning products in accordance with principles of the present disclosure.
Figure 6:
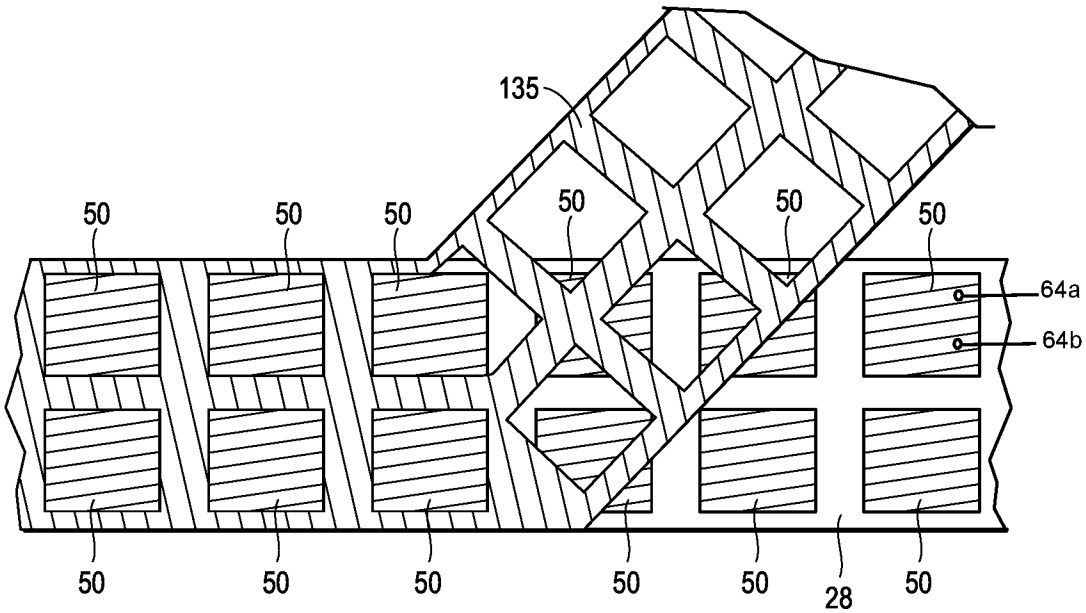
FIG. 6 is side view of the web of cleaning products prior to cutting away excess portions of the first and second films to create the individual pouches.

Referring to FIGS. 5 and 6, a method of manufacturing the web 8 of cleaning products 10 will now be described. FIG. 5 illustrates the first film 60 being fed from a roll into a thermoformer 100 together with, and on top of, the first carrier sheet 20. The first carrier sheet 20 and the first film 60 may pass between rollers (not shown) which place them in intimate, flush contact, with substantially no air trapped between them, before passing to the thermoformer 100. In the thermoforming process, both the first carrier sheet 20 and the first film 60 are formed simultaneously. That is, the thermoformer 100 creates the depressions 26 in the first carrier sheet 20, as well as, the internal holders 52 in the first film 60, at the same time.

The thermoforming process entails vacuum forming or pressure forming, or some combination of the two. Vacuum forming may involve heating the first carrier sheet 20 and the first film 60, pressing a mold against the first film 60, and vacuuming out air between the first film 60 and the mold so that the first carrier sheet 20 and the first film 60 assume the shape of the mold. Pressure forming may involve heating the first carrier sheet 20 and the first film 60, pressing the first carrier sheet 20 against a mold by vacuuming out air between the first carrier sheet 20 and the mold, and applying positive air pressure above the first carrier sheet 20 and the first film 60 so that the first film 60 assumes the shape of the mold.

Thermoforming creates a temporary, or permanent, affinity between the first carrier sheet 20 and the first film 60 such that the first film 60 clings to the first carrier sheet 20. The affinity between the first carrier sheet 20 and the first film 60 may be sufficient to prevent air from seeping between the first carrier sheet and the first film 60. It may be possible to peel the first film 60 away from the first carrier sheet 20 at this stage, if so desired. If left for a period of time, the first film 60 may begin to shrink-back. However, the time required for shrink-back to begin is considerably extended, as compared to the rate of shrink-back of a film which has not been thermoformed together with a carrier sheet. The affinity between the first film 60 and the first carrier sheet 20 is useful when the internal holders 52 are filled by a filing machine 110 with the cleaning composition 70. Since little or no shrink-back of the first film 60 occurs prior to filling, most if not all, of the interior volume of each of the interior cavities 56 of the internal holders 52 may be filled with the cleaning composition 70.

Once the internal holders 52 have been filled with their respective doses of the cleaning composition 70, the web may be advanced into a vacuum sealing machine 120 having a vacuum chamber 125. An internal pressure P3 of the vacuum chamber 125 may be equal to atmospheric pressure at the time when the web is conveyed into the vacuum chamber 125 through one of its open doors 127. Once the web is inside the vacuum chamber 125, the doors 127 may be closed, and the air inside the vacuum chamber 125 may be completely, or partially, evacuated so that the internal pressure $P_3$ of the vacuum chamber 125 is reduced to zero, or substantially close to zero. The internal pressure $P_3$ of the vacuum chamber 125 may be reduced to a range between approximately (e.g., ±10%) $1\times10^{-1}$ to $3\times10^{3}$ Pa, or $1\times10^{-7}$ to $1\times10^{-1}$ Pa, or $1\times10^{-10}$ to $1\times10^{-7}$ Pa, or 0 to $1\times10^{-10}$ Pa. The vacuum sealing machine 120 may be any suitable conventional vacuum sealing machine, including those sold by Tiromat and MultiVac Inc.

While inside the evacuated vacuum chamber 125, the second film 62 may be positioned to cover the first film 60, and then sealed, at the sealing station 130, around the rim of each of the internal holders 52. Any suitable method may be used for sealing the first and second films 60, 62, including, for example, adhesives and welding by heat, ultrasound, laser, vibration, spin, radio frequency, solvent welding, or any combination thereof. After the sealing operation, the second film 62 encloses the contents of each of the internal holders 52, thereby forming the pouches 50. The internal atmosphere 80 enclosed within each of the pouches 50 may have the same composition and pressure as the atmosphere inside the vacuum chamber 125. Thus, if the vacuum chamber 125 is completely evacuated of air such that the internal pressure P3 is equal to, or substantially equal to, zero during the sealing of the first and second films 60, 62, then the internal atmosphere 80 of each of the pouches 50 will be a vacuum that is substantially free of air and has a pressure $P_1$ equal to, or substantially equal to, zero. In one embodiment the pressure $P_1$ of each of the pouches may be in a range between approximately (e.g., ±10%) $1\times10^{-1}$ to $3\times10^{3}$ Pa, or $1\times10^{-7}$ to $1\times10^{-1}$ Pa, or $1\times10^{-10}$ to $1\times10^{-7}$ Pa, or 0 to $1\times10^{-10}$ Pa.

In some embodiments, the vacuum chamber 125 may not be completely evacuated of air, such that the pressure $P_1$ of each of the pouches is above zero, but still below atmospheric pressure. In still further embodiments, after evacuation of air from the vacuum chamber 125, a gaseous mixture different from air may be introduced into the vacuum chamber 125, so that the internal atmosphere 80 of each of the pouches 50 contains the gaseous mixture.

Next, to separate the individual pouches 50 from each other, the first and second films 60, 62 are cut at the cutting station 140. This may be achieved by die-cutting through the first and second films 60, 62 around the rims of each of the pouches 50, but not through the underlying carrier sheet 20. Subsequently, the waste in-between material may be removed at a rewind station 150. FIG. 6 illustrates a plan view of this operation. After cutting the first and second films 60, 62 at the cutting station 140, the waste material 135 is removed upwards to the rewind station 150, leaving behind the separated pouches 50, each being held in its respective depression 26 in the carrier sheet 20. A portion of the upper surface 28 of the carrier sheet 20 may be exposed by this process. The cutting and removal process may be similar to that used in the flat bed die-cutting of self-adhesive labels (in which only the self-adhesive face material is cut, leaving the self-adhesive label adhering to the uncut siliconed release material.

Once the pouches 50 have been cut and the waste material 135 removed, the doors 127 of the vacuum sealing machine 120 may be opened. This introduces air into the vacuum chamber 125, and raises the pressure $P_3$ back to atmospheric pressure. Since the pouches 50 are sealed close, the pressure $P_1$ of the internal atmosphere 80 of the pouches 50 remains at same pressure that existed inside the vacuum chamber 125 during the sealing process. The pressure differential between the internal atmosphere 80 and the atmosphere outside of the pouches 50 results in a compressive force that pushes against the exterior of each of the pouches 50 and compresses the pouches 50 and their cleaning composition 70 into their respective depressions 26 in the first carrier sheet 20. As discussed above, the compressive force may shrink the pouches 50, thereby reducing their interior volumes. Consequently, empty space between the particles of the cleaning composition 70, and/or between the cleaning composition 70 and the internal walls of the pouches 50, may be substantially reduced, or eliminated. The reduction in empty space may increase the overall rigidity and/or hardness of the pouches 50.

Next, the lines of sealing material 34 may be applied to the exposed upper surface 28 of the carrier sheet 20 at the sealing station 160. The lines of sealing material 34 may be made of any suitable adhesive material including, for example, epoxies, polyurethanes, acrylics, and/or silicones. As illustrated in FIG. 2, the lines of sealing material 32 may be formed about the rim of each of the depressions 26. Alternatively, or additionally, a line of sealing material 34 may follow the outer peripheral edge of the carrier sheet 20.

Following the application of the lines of sealing material 34, the second carrier sheet 30 may be fed from a roll into face-to-face contact with the upper surface 28 of the first carrier sheet 20, and then pressed against the carrier sheet 20 at the pressing station 160. The second carrier sheet 30 adheres to the upper surface 28 of the first carrier sheet 20 by virtue of the lines of sealing material 34. The adhesion of the second carrier sheet 30 to the first carrier sheet 20 creates a seal around each of the depressions 26 to enclose the pouches 50 therein. The internal atmosphere 82 captured between the first and second carrier sheets 20 and 30 during the sealing procedure may substantially correspond, in composition and pressure, to the ambient atmosphere where the sealing procedure occurred. Accordingly, if the first and second carrier sheets 20 and 30 are sealed together in an environment having atmospheric pressure, the internal atmosphere 82 between the first and second carrier sheets 20 and 30 will have a pressure $P_2$ equal to, or substantially equal to, atmospheric pressure. The pressure differential ΔP between the pressure P1 and the pressure P2 may maintain the external compressive force on the pouches 50 while the pouches 50 are stored between the first and second carrier sheets 20 and 30.

In one embodiment, after the first and second carrier sheets 20 and 30 are sealed together, a gaseous mixture is injected between the first and second carrier sheet 20 and 30, thereby increasing the pressure $P_2$. This may provide an additional compressive force on the exteriors of the pouches 50 to help them maintain their shape.

Finally, the weakened tear lines 36, 38 may be formed in the first and second carrier sheets 20 and 30 at the cutting station 180. The weakened tear lines 36, 38 may be formed by any suitable method including, for example, laser etching and/or scoring. The weakened tear lines 36 may divide the first carrier sheet 20 into a plurality of external holders 40. The weakened tear lines 38 may divide the second carrier sheet 30 into a plurality of external lids 42, each covering a respective one of the plurality of external holders 40. The weakened tear lines 36, 38 may be formed simultaneously so that each of the weakened tear lines 38 is aligned with a corresponding one of the weakened tear lines 36. The weakened tear lines 36, 38 may enable individual detachment of the cleaning products 10 from the web 8.

The foregoing embodiment employs a vacuum chamber to control the pressure $P_1$ of the internal atmosphere 80 of the pouches 50. As an alternative to the vacuum chamber, other embodiments may create holes 64*a* and 64*b* in the second film 62. These holes 64*a* and 64*b* may be formed in the portions of the second film 62 that correspond to the internal lids 54 of the pouches 50. The holes 64*a* and 64*b* may be formed before, or after, sealing the second film 62 to the first film 60. After sealing the second film 62 to the first film 60, the air inside the pouches 50 may be completely, or partially, evacuated through the holes 64*a* and 64*b* in the second film 62 to lower the pressure $P_1$ to a target level. Following the evacuation procedure, the holes 64*a* and 64*b* in the second film 62 may be sealed close so that the pressure $P_1$ inside the pouches 50 is maintained. Additionally, or alternatively, the holes 64*a* and 64*b* may be used to flush the pouches 50 with the gaseous mixture described above.

Figure 7:
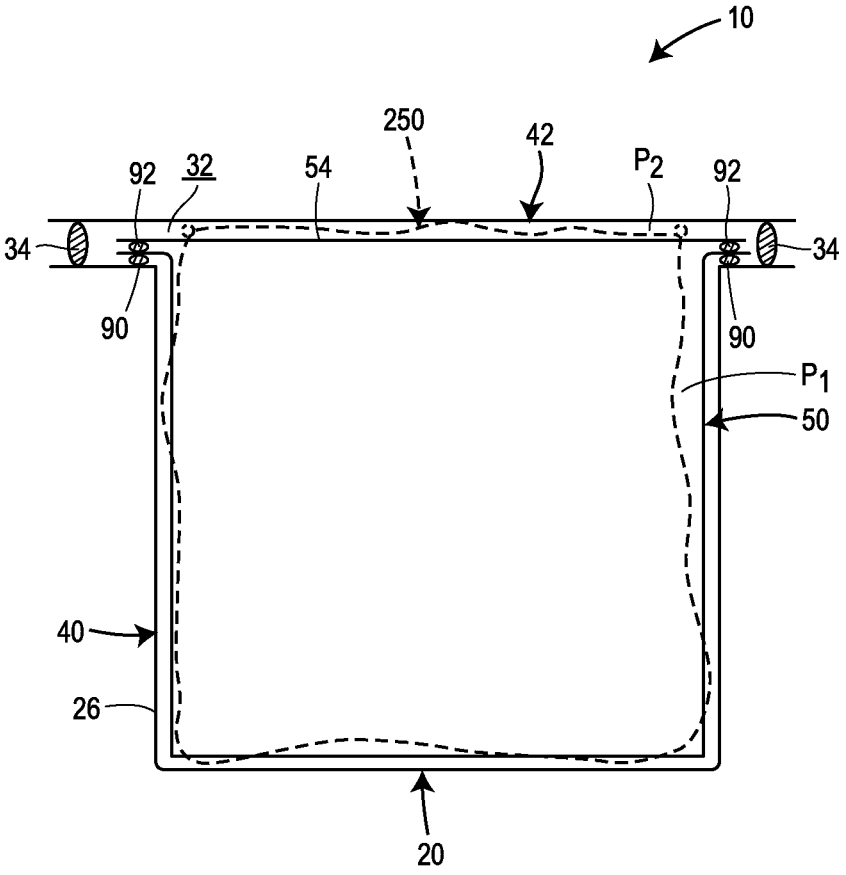
FIG. 7 illustrates a cross-sectional view of a cleaning product constructed in accordance with principles of the present disclosure and a conventional cleaning product.

FIG. 7 illustrates a comparison between a pouch 50 constructed in accordance with principles of the present disclosure and a conventional pouch 250. Since pressure P2 is larger than pressure P1, the pouch 50 and its cleaning composition 70 may be compressed into the depression 26. As a result, the exterior shape of the pouch 50 may conform to the interior shape of the depression 26 in the carrier sheet 20. By contrast, the conventional pouch 250, which is not subjected to a pressure differential (i.e., pressure P1 is equal to pressure P2), does not experience a compressive force. Accordingly, the conventional pouch 250 may not conform to the shape of the depression 26, as seen in FIG. 7.

An additional benefit of evacuating the pouches 50 in accordance with principles of the present disclosure is that the first and second films 60, 62 are tensioned over the cleaning composition 70. This tension may increase the rate at which the first and second films 60, 62 dissolve when exposed to water. Accordingly, evacuation of the pouches 50 may improve their ability to dissolve during the cleaning cycle.

From the foregoing, it can be seen that the present disclosure advantageously provides an improved configuration and method of forming a web of cleaning products. By lowering the pressure of the internal atmosphere of the pouches, it is possible to compress the pouches and thereby increase their hardness and/or rigidity. This may impart the pouches with a better defined shape and may allow for the customization if their shape. Furthermore, the compressive force provided by the difference in pressures ensures that the pouches retain the shape of their respective depressions in the carrier sheet prior to their removal by the consumer. Additionally, the increased firmness of the pouches may be preferred by consumers, and may signify to them that the pouches are of superior quality.

While the present disclosure has been described with respect to certain embodiments, it will be understood that variations may be made thereto that are still within the scope of the appended claims.

What is claimed is:

1. A method of making a web of cleaning products, the method comprising:

positioning a first film to cover a first carrier sheet;

feeding the first film and the first carrier sheet on to a mold of a forming machine with the first carrier sheet being positioned between the mold and the first film;

forming the first film and the carrier sheet over the mold at the same time to define a plurality of internal holders in the first film and a plurality of external holders in the first carrier sheet corresponding with the plurality of internal holders;

filling each of the plurality of internal holders with a cleaning composition;

positioning a second film to cover the first film;

evacuating air between the first film and the second film;

sealing the second film about a rim of each of the plurality of internal holders to define a plurality of pouches and to enclose a first internal atmosphere within each pouch of the plurality of pouches;

sealing, via a sealing material or weld, at least a portion of at least one pouch of the plurality of pouches to the first carrier sheet;

exposing the plurality of pouches to an external pressure greater than an internal pressure of each pouch of the plurality of pouches so that the external pressure compresses the plurality of pouches and at least a portion of the cleaning composition in the plurality of pouches into the plurality of external holders in the first carrier sheet; and sealing a second carrier sheet to the first carrier sheet while exposing the plurality of pouches to the external pressure to enclose the plurality of pouches in their corresponding external holders and to confine a second internal atmosphere to a region below the second carrier sheet and above the at least a portion of the at least one pouch.

2. The method of claim 1, the first and second films being made of a water-soluble material.

3. The method of claim 1, the first and second carrier sheets being made of a water-resistant material.

4. The method of claim 1, comprising sealing the second carrier sheet about a rim of each of the external holders.

5. The method of claim 1, comprising sealing the second film to the first film inside a vacuum chamber having an absolute pressure substantially equal to zero so that the internal pressure of each of the plurality of pouches is substantially equal to zero.

6. The method of claim 1, comprising forming a plurality of holes in the second film and, after sealing the second film to the first film, evacuating air from the plurality of pouches through the plurality of holes.

7. The method of claim 6, comprising sealing close the plurality of holes after evacuating the air between the first and second films.

8. The method of claim 1, comprising filling each of the plurality of pouches with a gaseous mixture different from air.

9. The method of claim 1, comprising cutting the first film and the second film and removing an area of waste material produced by cutting the first film and the second film to separate the plurality of pouches.

10. The method of claim 1, comprising sealing the second carrier sheet to the first carrier sheet about a rim of each of the plurality of external holders so that each of the plurality of external holders defines a respective sealed internal cavity.

11. The method of claim 10, comprising forming a first plurality of weakened tear lines in the first carrier sheet about the rim of each of the external holders, and forming a second plurality of weakened tear lines in the second carrier sheet to define a plurality of external lids corresponding with the plurality of external holders, each of the second plurality of weakened tear lines being aligned with a corresponding one of the first plurality of weakened tear lines.

12. The method of claim 1, wherein sealing, via the sealing material or weld, the at least a portion of the at least one pouch to the first carrier sheet comprises sealing, via the sealing material or weld, an outwardly extending peripheral flange of the at least one pouch to an upper surface of the first carrier sheet to form a seal around a rim of at least one of the plurality of external holders in the first carrier sheet.

13. The method of claim 1, wherein, at least after the second carrier sheet has been sealed to the first carrier sheet, the second internal atmosphere pushes the at least one pouch in a downward direction into a respective external holder of the plurality of external holders in the first carrier sheet.

* * * * *